United States Patent [19]

Trokhan

[11] 4,191,609

[45] Mar. 4, 1980

[54] SOFT ABSORBENT IMPRINTED PAPER SHEET AND METHOD OF MANUFACTURE THEREOF

[75] Inventor: Paul D. Trokhan, Hamilton, Ohio

[73] Assignee: The Procter & Gamble Company, Cincinnati, Ohio

[21] Appl. No.: 19,038

[22] Filed: Mar. 9, 1979

[51] Int. Cl.[2] ..... D21H 5/02; D21H 5/24

[52] U.S. Cl. ..... 162/113; 162/116; 162/117; 162/207

[58] Field of Search ..... 162/113, 116, 117, 207, 162/290, 348, DIG. 1; 128/284; 139/425 A, 383 R

[56] References Cited

U.S. PATENT DOCUMENTS

| | | | |
|---|---|---|---|
| 3,301,746 | 1/1967 | Sanford et al. | 162/113 |
| 3,473,576 | 10/1969 | Amneus | 139/425 A |
| 3,573,164 | 3/1971 | Friedberg et al. | 139/425 A X |
| 3,707,430 | 12/1972 | Costanza et al. | 128/284 |
| 3,905,863 | 9/1975 | Ayers | 162/113 |
| 3,908,659 | 9/1975 | Wehrmeyer et al. | 128/284 X |
| 3,974,025 | 8/1976 | Ayers | 162/113 |

*Primary Examiner*—Richard V. Fisher

*Attorney, Agent, or Firm*—Thomas J. Slone; Fredrick H. Braun; Richard C. Witte

[57] ABSTRACT

Wet-laid paper having, when creped, improved bulk, softness, and flexibility; a relatively large cross-machine-direction to machine-direction stretch ratio; and improved burst to total tensile strength ratio. The paper is characterized by an array of uncompressed zones which are in staggered relation in both the machine direction and the cross-machine direction; and by having each uncompressed zone defined by a picket-like discontinuous lineament of compacted fibrous material. The invention also includes a process for making the paper through the use of an imprinting fabric which is configured to precipitate the requisite compacting of the picket-like lineaments prior to final drying and creping of the paper.

8 Claims, 22 Drawing Figures

SOFT ABSORBENT IMPRINTED PAPER SHEET AND METHOD OF MANUFACTURE THEREOF

DESCRIPTION

Technical Field

This invention relates to soft absorbent imprinted paper, and a method of manufacturing such paper. Imprinted paper is paper which has had a pattern impressed on it in a papermaking machine by biasing a patterned member (such as an imprinting fabric) against another member (such as a back up roll or Yankee dryer drum) while an embryonic paper web is passed therebetween prior to the final drying of the paper web.

CROSS-REFERENCE TO RELATED APPLICATION

Reference is made to Ser. No. 019,028, filed even date by the same applicant, entitled "Papermaking Clothing Having A Surface Comprising A Bilaterally Staggered Array of Wicker-Basket-Like Cavities.

Background Art

A soft, absorbent, wet-laid imprinted creped paper which is characterized by alternately spaced unbroken ridges of uncompressed fibers and troughs of compressed fibers, which ridges and troughs extend in the cross-machine-direction (hereinafter CD) is disclosed in U.S. Pat. No. 3,301,746 which issued Jan. 31, 1967 to L. H. Sanford et al., as well as a process for making such paper. The Sanford et al. patent expressly discloses the use of imprinting fabrics which may be of square or diagonal weave, as well as twilled and semi-twilled fabrics.

Another soft, absorbent, wet-laid imprinted creped paper which is characterized by discrete CD aligned uncompressed zones or pillows is disclosed in U.S. Pat. No. 3,974,025 which issued Aug. 10, 1976 to Peter G. Ayers, and a process for making such paper is disclosed in U.S. Pat. No. 3,905,863 which issued Sept. 16, 1975 to Peter G. Ayers. These patents disclose imprinting the paper with an imprinting pattern from the back side of a semitwill woven imprinting fabric which has been heat-set and abraded to provide flat-faced knuckles.

As compared to the paper characterized by unbroken uncompressed CD ridges of Sandord et al., and the paper characterized by CD aligned uncompressed zones of Ayers, the paper provided by the present invention is characterized by an array of uncompressed zones of fibers which are disposed in staggered relation in both the CD and the machine direction (hereinafter MD), and which zones are perimetrically enclosed by picket-like lineaments comprising regions of compressed fibers; that is, by discontinuous rather than unbroken or continuous lines of compression.

An absorbent pad of air-laid fibers which is pattern densified essentially only by means of compression to provide a bilaterally staggered array of generally circular uncompressed tufts is disclosed in U.S. Pat. No. 3,908,659 which issued Sept. 30, 1975 to Bernard Martin Wehrmeyer et al. As compared to this dry-laid structure having continuous lines of compression, the paper of the present invention is wet-laid, and has discontinuous lines/lineaments of compression/imprinting which are imparted to the paper prior to its final drying. The paper of the present invention may also be creped after being imprinted and dried.

A fragmentary view of a 5-shed satin weave fabric having a non-numerically-consecutive warp pick sequence (1, 4, 2, 5, 3) is shown in FIG. 3–7, page 22, of the book titled *Papermachine Felts and Fabrics*, copyrighted by Albany International Corporation, 1976; Library of Congress Cat. Card No. 76–41647. Also, wet-end fabrics (commonly referred to as "wires" albeit comprising thermoplastic filaments rather than metal wire) of this weave are commercially available from Appleton Wire Works Corp., Appleton, Wisconsin. However, the book reference does not suggest the use of such a woven fabric as an imprinting fabric and, therefore, does not teach the use of such a fabric to achieve a particular objective with respect to the structure of a paper sheet imprinted thereby. Moreover, it is believed that the commercially available wet-end fabrics of this weave have not been heat-set to provide warp and shute knuckles (top-surface crossovers) in the same plane, or to provide subtop-surface crossovers which are spaced below the plane defined by the coplanar/monoplanar knuckles. The coplanar knuckles are hereinafter referred to as top-surface-plane crossovers and, in combination with the sub-top-surface crossovers, are very important with respect to imprinting fabrics which can be used to manufacture paper embodying the present invention.

U.S. Pat. No. 3,473,576 which issued Oct. 21, 1969 to J. S. Amneus teaches the weaving and heat treating of polyester fabrics to provide coplanar warp and shute knuckles having equal heights.

U.S. Pat. No. 3,573,164 which issued Mar. 30, 1971 to N. D. Friedberg and Charles L. Wosaba II discloses abrading high portions of filament crossovers to provide flat-faced knuckles as shown in their FIGS. 3 and 4. Such flat-faced knuckles are incorporated in the heat-set imprinting fabrics disclosed in the Ayers' patents discussed hereinabove.

The phrase warp-pick-sequence as used above and hereinbelow relates to the sequence of manipulating the longitudinally extending warp filaments in a loom to weave a fabric as the shuttle is traversed back and forth laying the shute filaments. If, as in all of the plan-view figures of fabric pieces included in this application, the warps are cyclically numbered from left to right so that they are numbered in sets of 1 through n for an n shed fabric (e.g.: warps 62-1 through 62-5 for the 5-shed, n=5 fabric shown in FIG. 7), then a warp-pick-sequence refers to the order of displacing the warps downwardly (into the paper as shown in FIG. 7) so that the next shute filament passes over the picked warp and under the other warps. Referring to FIG. 7, shute 63-1 was laid while all warps designated 62-1 were picked, and while all warps designated 62-2 through 62-5 were not picked. Thus, shute 63-1 passes over warps 62-1 and under warps 62-2 through 62-5 as shown in FIG. 7. Then, warps 62-1 are released and warps 62-3 are picked prior to passing the shuttle to lay shute 63-2. In the same manner, warps 62-5 are picked prior to laying shute 63-3; warps 62-2 are picked prior to laying shute 63-4; and warps 62-4 are picked prior to laying shute 63-5. Thus, using only the suffix digits of the warp and shute designators, the warp-pick-sequence to weave fabric 60, FIG. 7, is 1, 3, 5, 2, 4 to lay in shutes 1 through 5, respectively. This is a non-numerically-consecutive warp-pick-sequence as distinguished from the numerically-consecutive warp-pick-sequence manifest in fabrics 80, FIG. 11, and 90, FIG. 12, which fabrics have warp-pick-sequences of 1, 2, 3 and 1, 2, 3, 4, 5, respectively. Fabrics woven with non-numerically-consecutive warp-pick-sequences are amenable to being stressed and heat treated to provide coplanar warp and shute crossovers and some recessed sub-top-surface crossovers as described more fully hereinafter whereas fabrics woven with numerically consecutive warp-pick-sequences have no such sub-top-surface (recessed) crossovers. Also, opposite hand weaves having substantially similar properties can be formed through the use of a complimentary warp-pick-sequence. For instance, the compliment of 1, 3, 5, 2, 4 is 1, 4, 2, 5, 3. Alternatively, the compliment (opposite hand weave) can in fact be achieved by numbering the warps from right to left rather than left to right. That is, a fabric having its warps cyclically numbered −1 through −5 from left to right and woven with a warp-pick-sequence of 1, 3, 5, 2, 4 is the complimentary opposite hand weave of a fabric having its warps cyclically numbered −1 through −5 from right to left and woven with the same warp-pick-sequence of 1, 3, 5, 2, 4.

As compared to the background art, the present invention provides a soft, absorbent wet-laid sheet of paper which is characterized by an array of uncompressed zones which zones are staggered in both the machine direction and the cross-machine direction, and which zones are perimetrically enclosed by imprinting imparted picket-like discontinuous lineaments. When creped, this paper provides relatively high bulk; an improved CD:MD stretch ratio; reduced CD flexural rigidity which is believed to impute an increased subjectively ascertainable softness impression; and improved burst to total tensile strength ratio.

DISCLOSURE OF THE INVENTION

In accordance with one aspect of the present invention, there is provided a soft, absorbent paper sheet which is characterized by an array of uncompressed zones, which zones are staggered in both the machine direction (MD) and the cross-machine-direction (CD), and which zones are perimetrically enclosed by imprinting imparted picket-like-discontinuous lineaments. The preferred density of the zones is from about 15 to about 3,000 zones per square inch (about 2 to about 450 zones per square centimeter). When creped, this paper provides relatively high bulk; an improved CD:MD stretch ratio; reduced CD flexural rigidity which is believed to impute an increased subjectively ascertainable softness impression; and improved burst to total tensile strength ratio. This paper may be made by the process comprising the steps of imprinting the paper with a suitably patterned imprinting member prior to the final drying of an embryonic paper web coursing through a papermaking machine, and by creping the imprinted paper after it has been dried to the desired degree of dryness for the finished paper.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated, and in which:

DETAILED DESCRIPTION OF THE INVENTION

Figure 1:
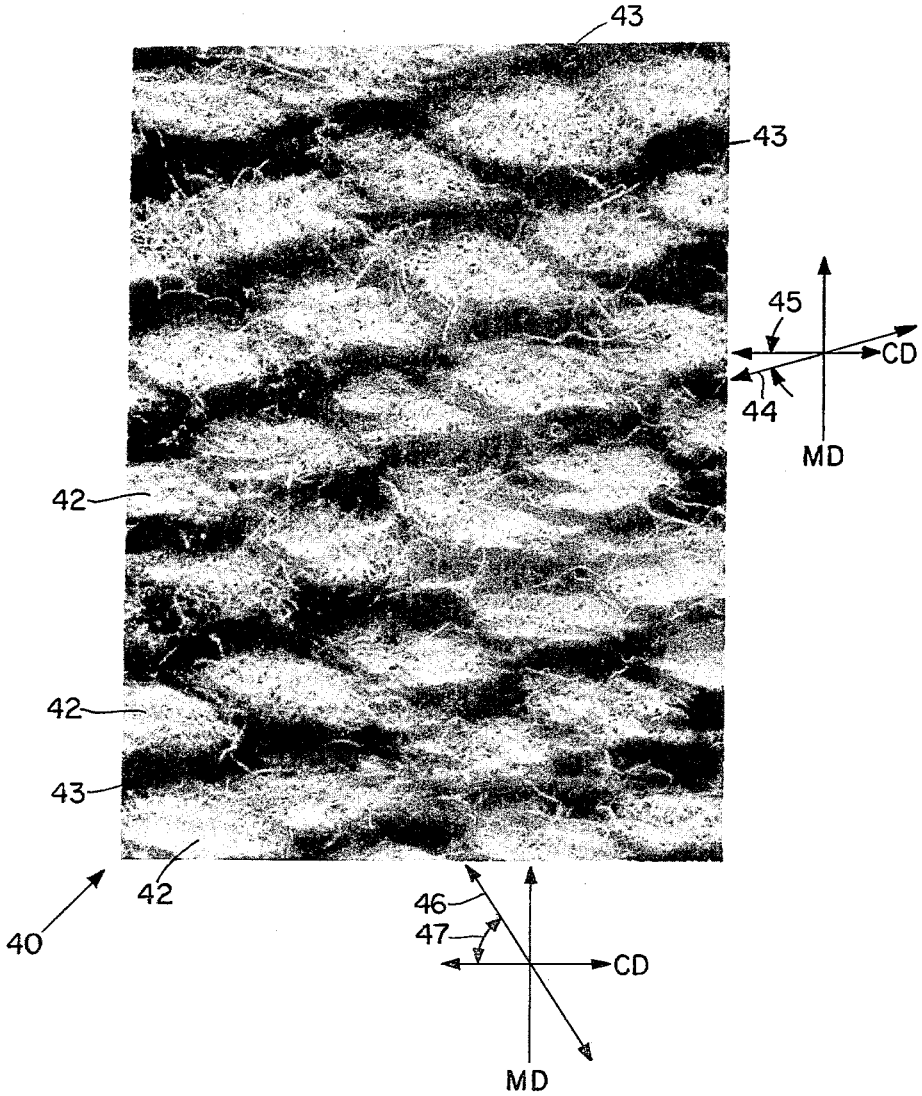
FIG. 1 is an enlarged photographic view of the fabric imprinted side of a fragmentary piece of imprinted creped paper embodying the present invention.

Referring now to the Figures in which like features are identically designated, FIG. 1 is an enlarged photographic view of the fabric imprinted side of a fragmentary piece of imprinted creped paper 40 embodying the present invention. As shown in FIG. 1, paper sheet 40 is characterized by an array of uncompressed zones 42 which zones are disposed in staggered relation in both the machine direction (MD) and the cross-machine direction (CD), and which zones 42 are individually perimetrically enclosed by imprinting imparted picket-like discontinuous lineaments which lineaments are discussed more fully hereinafter in conjunction with FIG. 7. However, as viewed in FIG. 1, the picket-like lineaments are zones of compacted fibers, which combine corporately to form the dark shaded areas of FIG. 1. These areas can be viewed as defining two sets of lines of compression: a first set of parallel lines of compression which extend in the direction indicated by arrow 44 and inclined upwardly to the right at angle 45 from the CD direction; and a second set of generally parallel, sinuous lines of compression which extend in the general direction indicated by arrow 46 and are inclined upwardly to the left at angle 47 from the CD direction. Thus, as indicated by angles 45 and 47, neither set of the lines of compression extend in either the machine direction or the cross-machine direction. In general, it is believed this geometry precipitates diminished flexural rigidity in the CD direction as compared to comparable paper embossed with sets of CD and/or MD lines of compression.

Figure 6:
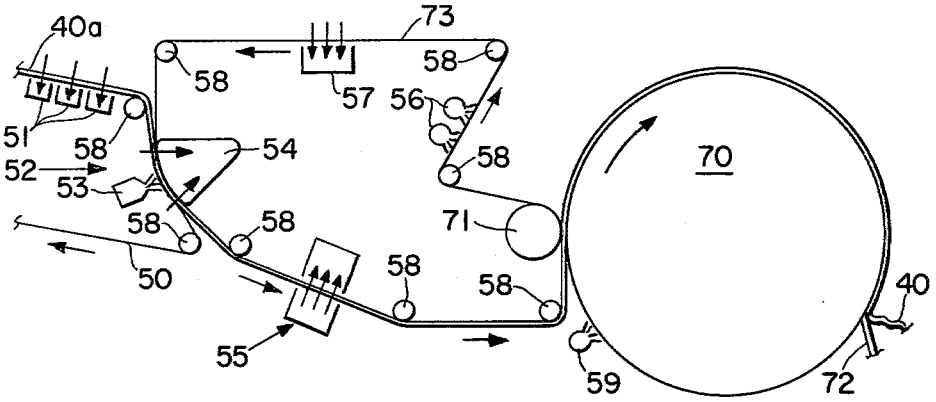
FIG. 6 is a side elevational, reduced scale fragmentary portion of a somewhat schematic papermaking machine for manufacturing paper embodying the present invention.

Briefly, paper sheet 40, FIG. 1, was made as a two layer web from two furnishes: a first furnish which formed the fabric imprinted layer of the finished paper and a second furnish which formed the other layer of the finished paper; the layer which contacted the Yankee drying drum of the papermaking machine, FIG. 6. The first furnish comprised about 9 pounds per 3000 square feet of relatively long fiber northern softwood (spruce and/or pine) kraft such as Grand Prairie Charmin Prime available from Procter & Gamble Cellulose, Limited of Canada. The second furnish comprised an admixture of about 5 pounds per 3000 square feet of relatively short fiber mercerized southern softwood kraft such as HPZ manufactured by The Buckeye Cellulose Corporation, and about 5 pounds per 3000 square feet of relatively short fiber southern hardwood kraft which had been post bleach extracted with cold caustic solution. A suitable southern hardwood kraft is known as Natchez-98 which is available from International Paper Company. After formation, layering, and initial dewatering, the embryonic paper web **40*a* was transferred from an upstream wire or fabric 50 to a drying-imprinting fabric 73 of the type shown in FIG. 7 and having a mesh count of 24×20 filaments per inch, and described more fully hereinafter. The fiber consistency at transfer was about 25 to about 30 percent. The embryonic web 40*a* was then transferred to a Yankee dryer drum 70 at a fiber consistency of about 70 to about 80 percent. Imprinting was effected at the point of transfer to the Yankee through the use of a pressure roll 71 as generally indicated in FIG. 6. Final drying was effected on the Yankee dryer drum 70, and the paper sheet was creped and removed from the Yankee by the action of doctor blade 72**.

Figure 2:
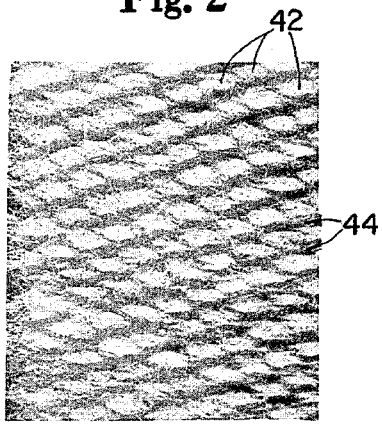
FIG. 2 is a photographic view similar to FIG. 1 except the degree of enlargement is less for FIG. 2 than FIG. 1.

FIG. 2 is a photographic view similar to FIG. 1 except the degree of enlargement is less for FIG. 2 than FIG. 1, and the fragmentary piece of paper 40 is therefore commensurately larger.

Figure 3:
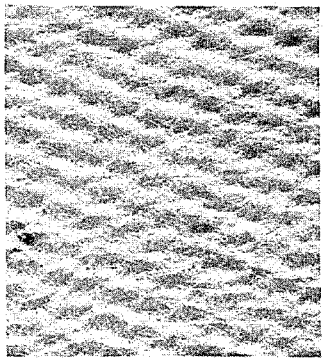
FIG. 3 is a photographic view of the opposite side (the dryer drum side) of the paper shown in FIG. 2.

FIG. 3 is a photographic view of the opposite side (Yankee dryer drum side) of the paper 40 shown in FIG. 2. FIGS. 2 and 3 have the same degree of enlargement and are included for the purpose of side-by-side comparisons with similar views of a piece of prior art paper 41 shown in FIGS. 4 and 5.

Figure 4:
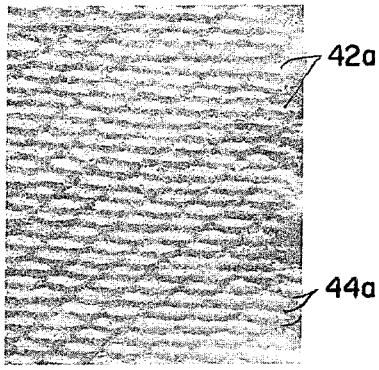
Fig. 4 PRIOR ART
FIG. 4 is a photographic view of the fabric imprinted side of a fragmentary piece of prior art imprinted creped paper in which view the degree of enlargement is the same as for FIGS. 2 and 3.
Figure 5:
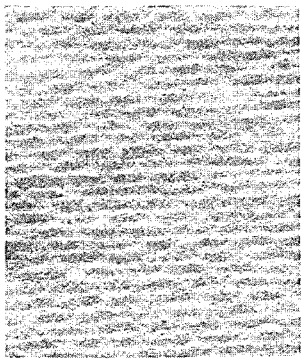
Fig. 5 PRIOR ART
FIG. 5 is a photographic view of the opposite side (the dryer drum side) of the fragmentary piece of prior art imprinted creped paper shown in FIG. 4 and in which view the degree of enlargement is the same as for FIG. 4.

FIG. 4 is a photographic view of the fabric imprinted side of a fragmentary piece of prior art imprinted creped paper 41 in which view the degree of enlargement is the same as in FIGS. 2 and 3. FIG. 5 is a photographic view of the opposite side (Yankee dryer drum side) of the fragmentary piece of prior art imprinted creped paper 41 shown in FIG. 4. This paper was described hereinbefore in conjunction with discussing U.S. Pat. No. 3,974,025 which is titled "Absorbent Paper Having Imprinted Thereon a Semi-Twill, Fabric Knuckle Pattern Prior to Final Drying".

When the paper 40, FIGS. 2 and 3, is compared in side-by-side relation with corresponding views of prior art paper 41 shown in FIGS. 4 and 5, it is quite apparent that the prior art paper 41 is characterized by cross-machine-direction lines of compression **44*a*, whereas the paper 40 is devoid of such cross-machine-direction lines of compression. Rather, it is apparent from these figures that the paper sheet 40 of the present invention is characterized by uncompressed zones 42 which are in staggered relation in both the CD and the MD directions, whereas the prior art paper 41 as seen in FIG. 4 is characterized by uncompressed zones 42*a*** which are aligned in the cross-machine direction.

FIG. 6 is a fragmentary side elevational view of a somewhat schematic papermaking machine 49 for manufacturing paper embodying the present invention. The papermaking machine 49 is shown fragmentarily because it is believed that the wet-end geometry of the machine is not critical to the present invention. However, in addition to the earlier brief description of the papermachine 49, the other members of the machine which are shown include vacuum dewatering boxes 51, transfer means 52 which includes air jet 53 and vacuum box 54, blow through pre-dryer means 55, fabric cleaning showers 56, fabric dewatering box 57, turning rolls 58, and adhesive applicator 59. The functions and operations of these members are believed to be well known to persons skilled in the papermaking machine art, and similar apparatus is disclosed in U.S. Pat. No. 3,301,746 which was referenced hereinbefore.

Figure 7:
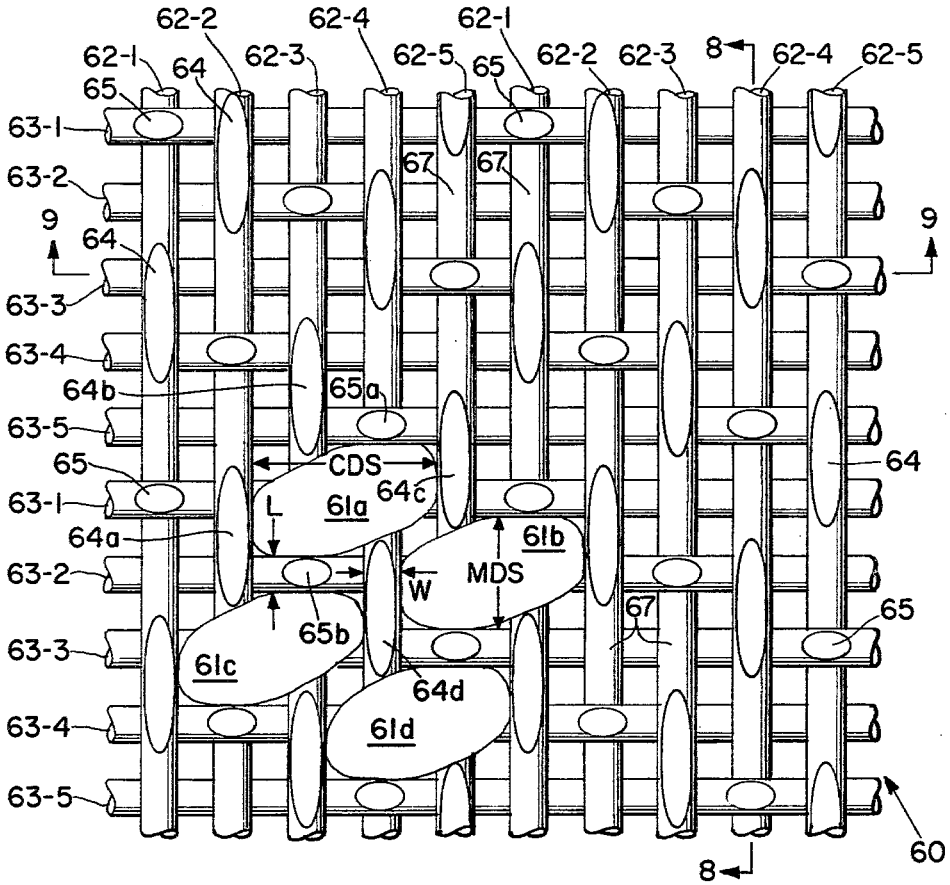
FIG. 7 is an enlarged scale fragmentary view of an imprinting fabric for imprinting an embryonic paper sheet according to the present invention.
Figure 8:
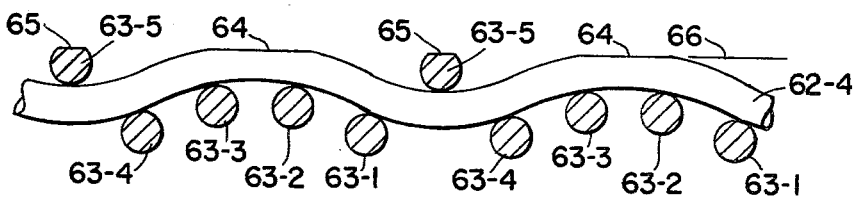
FIGS. 8 and 9 are fragmentary sectional views taken along lines 8—8 and 9—9, respectively, of FIG. 7.
Figure 9:
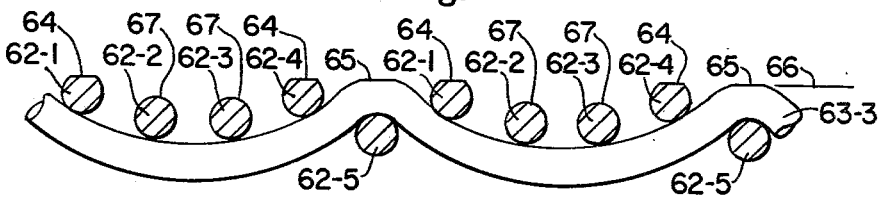

FIG. 7 is a fragmentary plan view of an imprinting fabric 60 having four (4) oval-shape planchets 61 disposed thereon. Fabric 60 comprises monofilament thermoplastic warps and shutes; preferably a polyester thermoplastic material. The warps and shutes of fabric 60 are designated MD-warp filaments 62 and CD-shute filaments 63 which are woven into a 5-shed satin weave using a non-numerically-consecutive 1, 3, 5, 2, 4 warp pick sequence. After being woven, fabric 60 is heat treated under tension to heat set the filaments in the complimentary serpentine configurations shown in the fragmentary sectional views taken along lines 8—8 and 9—9 of FIG. 7, and which views are identified as FIGS. 8 and 9, respectively. After being heat set, fabric 60 is subjected to an abrading means to provide elongate flat-faced crossovers (knuckles) 64 on the MD-warp filaments 62, and oval-shape flat-faced crossovers (knuckles) 65 on the CD-shute filaments 63. The flat-faced crossovers 64 and 65 are coplanar (alternatively referred to as monoplanar) and are alternately corporately designated top-surface-plane crossovers. That is, the flat faces of crossovers 64 and 65 define the top surface plane 66, FIGS. 8 and 9, of fabric 60. The remainder of fabric 60 is disposed below plane 66 and includes sub-top-surface crossovers (knuckles) 67. Thus, as shown in FIGS. 7 and 9, sub-top-surface crossovers 67 are disposed in sub-arrays of side-by-side pairs and, as shown in FIG. 7, each pair of sub-top-surface crossovers 67 are generally perimetrically enclosed by adjacent portions of four MD-warp crossovers 64 and two CD-shute crossovers 65. Each such network of crossovers and the intermediate spans of filaments form, in the nature of wicker-like baskets, concave depressions or cavities in which zones of an embryonic paper web can be accommodated without substantial compression or compaction while the top-surface crossovers 64 and 65 are imprinted on the embryonic paper web. In this manner, the uncompressed zones 42 of paper 40 are defined by discontinuous picket-like lineaments wherein the fibers of the paper are alternately compacted and not compacted. The planchets 61 are provided in FIG. 7 to indicate the plan-view shape of the above described wicker-basket-like cavities.

Figure 12:
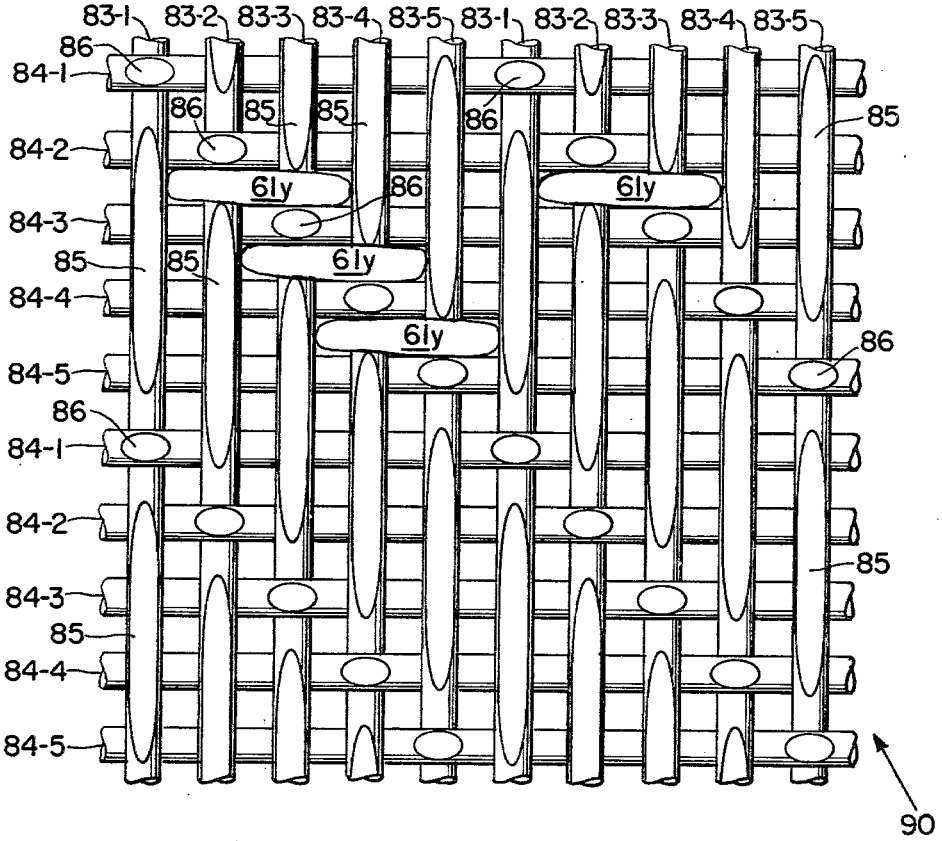
FIG. 12 is an enlarged scale fragmentary view of a five shed satin weave imprinting fabric of the type woven by consecutively picking warps during the weaving of the fabric.

Parenthetically, as used herein, the term "satin weave" is defined as a weave of n-shed wherein each filament of one set of filaments (e.g., warps or shutes) alternately crosses over one and under n-1 filaments of the other set of filaments (e.g., shutes or warps), and each filament of the other set of filaments alternately passes under one and over n-1 filaments of the first set of filaments. As illustrated in FIG. 12, fabric 90 is a five-shed satin weave which has been woven using a 1, 2, 3, 4, 5 warp-pick-sequence. Fabric 90 comprises sets of warp filaments 83-1 through 83-5, and shute filaments 84-1 through 84-5. The warps have elongate flat-faced knuckles 85 and the shutes have oval-shape flat-faced knuckles 86 which knuckles are coplanar. The wicker-basket-like cavities of fabric 90 are covered by planchets 61*y*. These cavities span two warp filaments and no shute filaments; and this fabric has no sub-top-surface knuckles comparable to, for instance, knuckles 67 of fabric 60, FIG. 7 as described more fully above. By way of contrast, the cavities of fabric 60, FIG. 7, span two warp filaments and one shute filament as indicated by planchets 61*a* through 61*d* which span two side-by-side sub-top-surface knuckles 195. Thus, the five-shed satin weave fabric 90 (numerically-consecutive warp-pick-sequence), FIG. 12, has no sub-top-surface crossovers whereas the five-shed satin weave fabric 60 (non-numerically-consecutive warp-pick-sequence), FIG. 7 has sub-top-surface crossovers 67.

Still referring to FIG. 7, the grouping of four planchets 61 clearly shows that the array of uncompressed zones 42 of a paper sheet 40 imprinted by fabric 60 are sufficiently closely spaced that the machine-direction span MDS of each zone (a reference zone) spans the machine-direction length L of the space intermediate a longitudinally spaced pair of zones which pair is disposed laterally adjacent the reference zone, and the array of zones are sufficiently closely spaced that the cross-machine-direction span CDS of each zone spans the cross-machine-direction width W of the space intermediate a laterally spaced pair of zones which pair is disposed longitudinally adjacent the reference zone. To illustrate these spatial relations, planchets 61*a* and 61*c*, FIG. 7, are a pair of longitudinally spaced planchets which are disposed laterally adjacent planchet 61*b*, and planchets 61*b* and 61*c* are a pair of laterally spaced planchets which are disposed longitudinally adjacent both planchet 61*a* and 61*d*. This degree of overlapping of the zones tends to obviate MD and CD tearing of such imprinted paper, and such an overlapped array is hereby designated a fully overlapped bilaterally staggered array.

Figure 10:
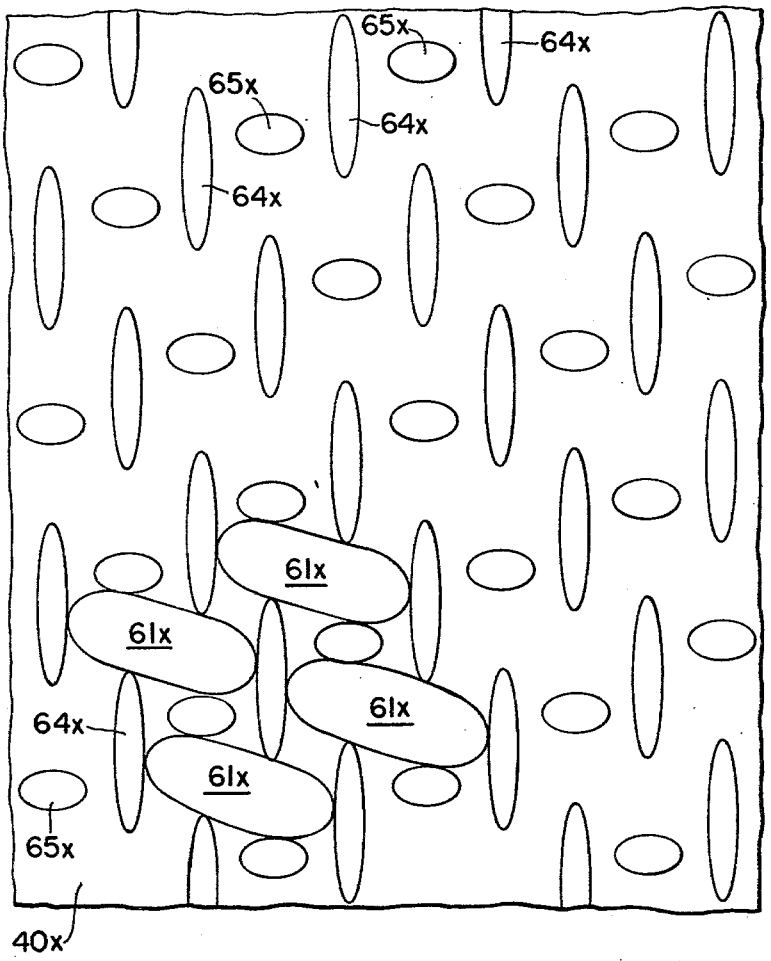
FIG. 10 is an enlarged scale fragmentary view of a sheet of paper which has had printed on it the knuckle pattern of the imprinting fabric shown in FIG. 7.

FIG. 10 is a plan view of a fragmentary sheet of paper 40*x* which has had the pattern of flat-face crossovers 64 and 65 of fabric 60, FIG. 7, printed (but not debossed as by imprinting) thereon. The prints of crossovers 64 are designated 64*x*, and the prints of crossovers 65 are designated 65*x*. Planchets 61*x* are indicated on FIG. 10 to illustrate the plan view shape of the zones of the paper which would not be substantially compressed by imprinting it with fabric 60. This figure also makes it clear that sub-top-surface knuckles 67 are indeed below the top surface plane 66 inasmuch as knuckles 67 did not print on paper 40*x*, FIG. 10.

Figure 11:
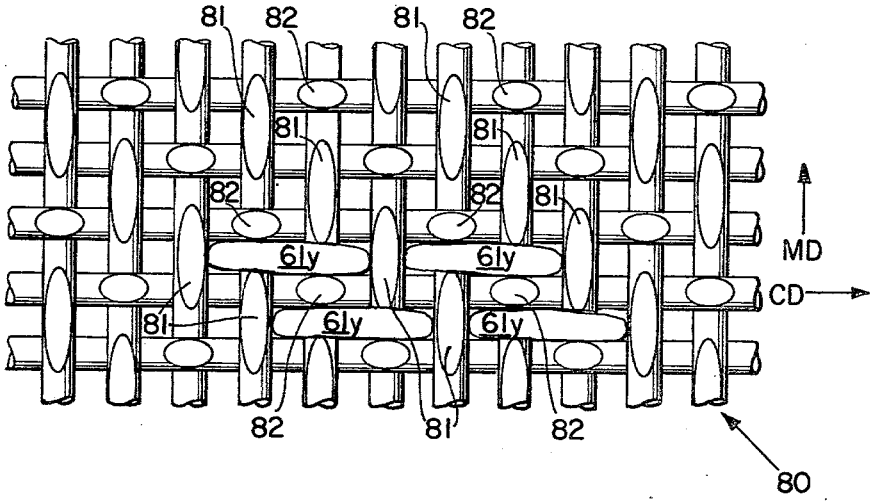
FIG. 11 is an enlarged scale fragmentary view of a prior art imprinting fabric.

Three sample pairs of paper 40, FIGS. 1 through 3, and prior art paper 41, FIGS. 4 and 5, were run (described below) to illustrate the comparative benefits of paper 40 with respect to prior art paper 41. Paper 40 was made using imprinting fabrics of the type designated 60 and shown in FIG. 7, and the prior art paper 41 was made using imprinting fabrics of the type shown in FIG. 11 and designated 80. Briefly, fabric 80, FIG. 11, comprises elongate MD knuckles 81 and oval-shape CD knuckles 82 and provides cavities for obviating compressed fibers which cavities are indicated by planchets 61*y*. As shown by the disposition of the planchets 61*y* in FIG. 11, paper which has been imprinted by this type fabric has elongate uncompressed zones which are aligned in the CD direction and staggered in the MD direction. This fabric 80 and paper 41 are more fully described in the two Ayers patents referenced hereinbefore. However, fabric 80 has no sub-top-surface knuckles comparable to sub-top-surface knuckles 67 of fabric 60. Therefore, the cavities of fabric span no sub-top-surface knuckles. This distinguishes fabric 80 from fabric 60 as well as all of the other alternate embodiment fabrics described hereinbelow.

Sample Pair I

These samples of paper sheet 40, FIGS. 1 through 3, embodying the present invention and prior art paper sheet 41, FIGS. 4 and 5, were imprinted by fabrics having 24×20 (filaments per inch) mesh counts in the MD and CD directions, respectively. But for the different imprinting fabric weaves, fabric 60 of FIG. 7, and fabric 80 of FIG. 11, the runs were substantially identical and made on the same papermaking machine. The papermaking machine comprised two headboxes and thus created discretely layered two-layer paper sheets. A first headbox of the fixed roof former type delivered a first furnish comprising northern softwood kraft (Grand Prairie Charmin Prime, Procter & Gamble Cellulose, Limited of Canada) which furnish formed the first layer of an embryonic paper web. The basis weight of the first layer was about fifty percent (50%) of the total basis weight of the finished paper sheet. A second headbox delivered a second furnish to a twin wire former to form the second layer of the paper sheet after which the first layer was juxtaposed the second to complete the formation of the embryonic web designated 40*a* in FIG. 6. The second furnish comprised a blend of about fifty percent (50%) each of HPZ and Natchez-98 which were both fully identified hereinbefore. Additionally, Parez 631-NC (American Cyanamid Corporation), a wet strength additive was introduced into the first furnish (northern softwood kraft) at the rate indicated in Table I below.

The first layer was formed on a 78×60 (filaments per inch) mesh S-weave forming wire (Appleton Wire Works), and the second layer was formed between a 74×56 (filaments per inch) mesh M-weave forming wire (also Appleton Wire Works) and a 78×60 (filaments per inch) mesh S-weave intermediate carrier wire. Parenthetically, an S-weave is a 4-shed satin weave with a numerically consecutive warp-pick-sequence having the long crossovers oriented in the cross-machine direction; an M-weave is a 5-shed satin weave with a non-numerically-consecutive warp-pick-sequence having the long surface crossovers oriented in the cross-machine direction. The M-weave fabric does not have coplanar warp and shute knuckles. The second layer was then carried on the intermediate wire to a position where the first layer was juxtaposed superjacent the second layer. This completed the formation of the embryonic paper sheet designated 40*a*, FIG. 6. The embryonic paper sheet 40*a* was then transferred to the appropriate imprinting fabric at a fiber consistency of from about 25 to about 30 percent. The embryonic paper sheets were further dried using blow through drying (pre-dryer means 55, FIG. 6) to a fiber consistency at transfer to the Yankee dryer drum 70 of from about 75 to about 80 percent. Imprinting with the fabrics occurred at the point of transfer to the Yankee. The paper sheets were dried to their desired end point dryness on the Yankee and then creped therefrom by doctor blade 72. The paper sheets were then drawn away from the doctor blade zone and reeled to provide an ultimate residual crepe of about 30%. Comparative data from Sample Pair I are tabulated in Table I. These data were obtained from comparable populations of data over a range of fabric knuckle areas (resulting from different degrees of abrading to provide a range of flat-face knuckle areas), and basis weights. Although the basis weight ranged from 15.4 to 20.4 pounds per 3000 square feet for paper sheet 40 of Sample Pair I, the remaining comparative data would be virtually unchanged if the data points were selectively limited to a basis weight range of 17.0 to 19.3 pounds per 3000 square feet.

SAMPLE PAIR I

TABLE I

SAMPLE PAIR I
Wet Strength Tissue

| Imprinting Fabric: Figure No.; | Paper 40 7 | Prior Art Paper 41 11 |
|---|---|---|
| Mesh (filaments per inch, MD × CD) | 24 × 20 | 24 × 20 |
| Caliper, Mils | 26.3 | 22.8 |
| CD Stretch, % | 10.6 | 8.3 |
| MD Stretch, % | 40.1 | 43.1 |
| CD:MD Stretch Ratio | .27 | .19 |
| Flexural Rigidity, CD, mg-cm | 47.9 | 69.8 |
| CD Tensile, grams/inch | 165 | 197 |
| MD Tensile, grams/inch | 234 | 336 |
| CD:MD Tensile Ratio | 1.4 | 1.7 |
| Total Tensile (CD + MD Tensiles) | 399 | 533 |
| Burst Strength, grams | 169 | 164 |
| Burst/Total Tensile Strength | .429 | .308 |
| Density, gms/cc | .043 | .050 |
| Nominal Basis Weight, pounds per 3000 square feet | 17.7 | 17.9 |
| Basis Weight Range, pounds per 3000 square feet | 15.4–20.4 | 17.7–18.2 |
| Parez 631-NC, usage rate range, pounds per ton of fibers | 10–16 | 8 |
| Accostrength 98 dry strength additive, pounds per ton of fibers | 0 | 0 |
| Accostrength 514 potentiating agent, pounds per ton of fibers | 0 | 0 |

Sample Pair II

These samples of paper sheet 40, FIGS. 1 through 3, embodying the present invention and prior art paper sheet 41, FIGS. 4 and 5, were imprinted by fabrics having 31×25 (filaments per inch) mesh counts in the MD and CD directions, respectively. The runs were substantially the same as made with respect to Sample Pair I except:

a. The fiber content of the second furnish was wholly southern hardwood kraft (Natchez-98 identified hereinbefore);
b. The fiber consistencies at the point of imprinting and transfer to the Yankee dryer drum ranged from about 65 to about 80 percent; and,
c. Specific fabric knuckle areas of twenty and thirty percent were used.

Comparative data are tabulated in Table II below.

SAMPLE PAIR II

TABLE II

SAMPLE PAIR II
Wet Strength Tissue

| Imprinting Fabric: Figure No.; | Paper 40 7 | Prior Art Paper 41 11 |
|---|---|---|
| Mesh (filaments per inch, MD × CD) | 31 × 25 | 31 × 25 |
| Caliper, Mils | 18.3 | 17.6 |
| CD Stretch, % | 8.9 | 8.2 |
| MD Stretch, % | 41.2 | 41.5 |
| CD:MD Stretch Ratio | .22 | .20 |
| Flexural Rigidity, CD, mg-cm | 61.2 | 73.3 |
| CD Tensile, grams/inch | 199 | 182 |
| MD Tensile, grams/inch | 347 | 346 |
| CD:MD Tensile Ratio | 1.7 | 1.9 |
| Total Tensile (CD + MD Tensiles) | 546 | 528 |
| Burst Strength, grams | 151 | 134 |
| Burst/Total Tensile Strength | .27 | .26 |
| Density, gms/cc | .063 | .067 |
| Nominal Basis Weight, pounds per 3000 square feet | 18.0 | 18.4 |
| Basis Weight Range, pounds per 3000 square feet | 17.8–18.2 | 18.0–18.8 |
| Parez 631-NC, usage rate range, pounds per ton of fibers | 6–8 | 6 |
| Accostrength 98 dry strength additive, pounds per ton of fibers | 0 | 0 |
| Accostrength 514 potentiating agent, pounds per ton of fibers | 0 | 0 |

Sample Pair III

These samples of paper sheet 40, FIGS. 1 through 3, embodying the present invention and prior art paper sheet 41, FIGS. 4 and 5, were imprinted by the same fabrics as were Sample Pair II described above. The runs were substantially the same as made with respect to Sample Pair II except the sheets were formed as three (3) layer structures rather than two layer structures through the use of a partitioned fixed roof headbox through which three furnishes were delivered to a 78×60 (filaments per inch) mesh count S-weave forming wire. The furnishes were provided so that both outer layers were eucalyptus hardwood kraft (Champion International) and the center layer was northern softwood kraft identified hereinbefore. Accostrength 98 which is a dry strength additive and Accostrength 514 which is a potentiating agent with respect to Accostrength 98 were added to the center layer furnish, and Parez 631-NC, a wet strength additive was added to the outer layer furnish which ultimately became the Yankee dryer drum side of the paper sheets 40 and 41, FIGS. 3 and 5 respectively, in order to control lint. Each of the three layers constituted about one-third of the basis weight of each sample paper sheet. After being formed on the 78×60 forming wire, the embryonic paper sheets were transferred to the same intermediate carrier wire as Sample Pairs I and II, and re-transferred to the appropriate imprinting fabric at a fiber consistency of from about 25 to about 30 percent. The fiber consistency was increased by blow through predrying to from about 75 to about 80 percent at the point of imprinting and transfer to the Yankee dryer drum. Residual crepe of 18 percent was provided and the paper sheet was calendared through a rubber-steel roll calendar stack. Prior to data sampling, the paper sheet samples were converted into a standard 4.5×4.5 inch toilet tissue format. Comparative data are tabulated in Table III below.

SAMPLE PAIR III

TABLE III

SAMPLE PAIR III
Dry Strength Tissue

| Imprinting Fabric: Figure No.; | Paper 40 7 | Prior Art Paper 41 11 |
|---|---|---|
| Mesh (filaments per inch, MD × CD) | 31 × 25 | 31 × 25 |
| Caliper, Mils | 12.1 | 11.5 |
| CD Stretch, % | 7 | 4 |
| MD Stretch, % | 24 | 21 |
| CD:MD Stretch Ratio | .28 | .19 |
| Flexural Rigidity, CD, mg-cm | 32.5 | 53.6 |
| CD Tensile, grams/inch | 161 | 182 |
| MD Tensile, grams/inch | 190 | 205 |
| CD:MD Tensile Ratio | 1.2 | 1.1 |
| Total Tensile (CD + MD Tensiles) | 351 | 387 |
| Burst Strength, grams | 120 | 100 |
| Burst/Total Tensile Strength | .34 | .26 |
| Density, gms/cc | .094 | .098 |
| Nominal Basis Weight, pounds per 3000 square feet | 17.9 | 17.6 |
| Basis Weight Range, pounds per 3000 square feet | 17.7–18.0 | 17.4–17.9 |
| Parez 631-NC, usage rate range, pounds per ton of fibers | 0 | 2 |
| Accostrength 98 dry strength additive, pounds per ton of fibers | 1 | 1 |
| Accostrength 514 potentiating agent, pounds per ton of fibers | 10 | 10 |

Referring to the tabulated data, the superiority of paper 40 embodying the present invention over prior art paper 41 is apparent from the tabulated data inasmuch as the data from all three sample pairs (Tables 1, 2 and 3) indicate:

a. Lower density/greater bulk;
b. Decrease CD flexural rigidity;
c. Greater CD:MD stretch ratios; and
d. Greater burst to total tensile strength ratio.

The significance of lower density/greater bulk is believed to be that it directionally tends to improve absorbency, and subjective (expert panel) softness perception.

The significance of decreased CD flexural rigidity is believed to be that softness impression is strongly influenced by the poorest directional property. That is, if MD rigidity is low and CD rigidity is high as it typically is because of CD crepe ridges, then CD properties will be disproportionately adversely influential on softness. Therefore, reducing CD rigidity as by obviating CD creping ridges without materially affecting MD rigidity is directionally right to achieve improved softness impression. This also makes the paper more clothlike inasmuch as it is more isotropic in its CD versus MD properties.

The significance of improved (greater) CD:MD stretch ratios is believed to be derived from:

a. Since strength properties in general are governed by the weakest component, the maximum strength perception at minimum technically measurable integrated strength will occur when the sheet is isotropic in strength properties. Those strength properties such as burst, and tensile energy absorption (or any work/energy absorption type of strength property) that are functions of stretch will directionally approach optimization as the CD:MD stretch ratio approaches 1.0;
b. Paper having isotropic stretch more closely simulates woven cloth; and
c. Achieving a relatively high CD:MD stretch ratio will allow the paper to be made with a relatively low percent crepe to achieve predetermined absolute level of CD stretch. Reduced creping results in better control of the papermaking machine and provides a potential for higher capacity (e.g., tons per day) at a given finished sheet basis weight.

The significance of improved Burst to Total Strength Ratio is believed to be related to burst strength being a measure of the paper's ability to resist forces and absorb energy in a direction perpendicular to the major plane of the paper sheet. Tensile on the other hand, measures strength properties generally within the major plane without regard to the total work done or energy absorbed. Burst strength can be normalized by ratioing it to Total Tensile Strength. Then, the ratio is particularly important as a measure of the strength acceptability of a tissue product in the dispensing mode or in any mode when relatively large normal forces are applied. Normalizing to a given tensile insures that other vital properties such as softness are not compromised in the pursuit of high burst strength.

Alternate Fabric Embodiments

Prior to describing several alternate fabric embodiments which are suitable for making paper 40, fabric weaving and nomenclature need to be reviewed.

As stated hereinbefore, the terms warp and shute (or woof) are terms associated with fabric on a loom: warp threads or filaments extend longitudinally in a loom; and shute threads or filaments extend in the lateral direction in a loom. Fabrics woven on conventional looms are formed into loops by weaving the top and bottom edges of the fabric together with warp ends which have been left extending from the top and bottom edges of the fabric. Thus, when such a fabric is placed on a papermaking machine (eg: imprinting fabric 73, FIG. 6) the warp filaments extend in the machine-direction, and the shute filaments extend in the cross-machine direction. Alternatively, endless loops of fabric can be woven on suitable looms wherein the warps and shutes are so disposed that, when the loop is applied to a papermachine, the warps extend in the cross-machine-direction and the shutes extend in the machine-direction. Thus, the terms warp and shute are potentially ambiguous with respect to machine-direction and cross-machine-direction. Accordingly, the weaves described hereinbelow are, for convenience and simplicity, explained using warp and shute with the intention that either type filament can extend in either the MD or CD on a papermaking machine. For that reason, neither MD nor CD is indicated on FIG. 7 or FIGS. 12 through 22. Accordingly, in more general terms, all of the fabrics are more generally described as comprising two sets of substantially parallel filaments which sets are generally disposed orthogonally with respect to each other.

Prior to describing several alternate embodiment satin weave fabrics, it is also desirable to understand that the staggered relation of the uncompressed areas 42 of paper 40, FIG. 1, result from non-numerically-consecutive warp-pick-sequences. The fabric 90, FIG. 12, is included to illustrate that a numerically-consecutive warp-pick-sequence precipitates uncompressed zones of the same size as the prior art fabric 80, FIG. 11, and comprises rows of such zones which are aligned in the direction of the shute filaments. As illustrated in FIG. 12, fabric 90 is a five-shed satin weave which has been woven using a 1, 2, 3, 4, 5 warp-pick-sequence. Fabric 90 comprises warp filaments 83-1 through 83-5, and shute filaments 84-1 through 84-5. The warps have elongate flat-face knuckles 85 and the shutes have oval-shape flat-face knuckles 86. Knuckles 85 and 86 are coplanar. The zones for not compressing a paper sheet which is imprinted by fabric 90 are covered by planchets 61y. These zones span two warp filaments and no shute filaments. By way of contrast, the zones (planchets 61) of fabric 60, FIG. 7, span two warp filaments and one shute filament. Thus, the five-shed satin weave fabric 60 (non-numerically-consecutive warp-pick-sequence) has sub-top-surface crossovers 67 whereas the five-shed satin weave fabric 90 (numerically-consecutive warp-pick-sequence) has no sub-top-surface crossovers.

Figure 13:
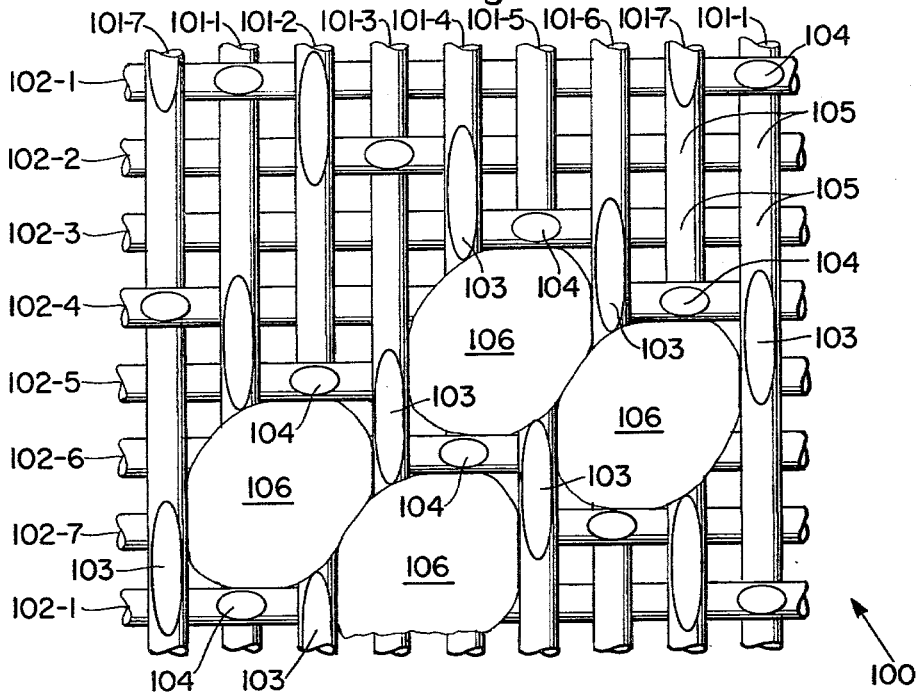
FIGS. 13 through 16 are enlarged scale fragmentary views of alternate embodiment satin weave imprinting fabrics for use in manufacturing paper embodying the present invention.

FIG. 13 is a plan view of a fragmentary piece of an alternate embodiment imprinting fabric 100 which is a seven-shed satin weave which comprises warps 101-1 through 101-7 and shutes 102-1 through 102-7, and which fabric has been woven with a 1, 3, 5, 7, 2, 4, 6 warp-pick-sequence. The warps and shutes have coplanar flat-face top-surface-plane knuckles 103 and 104, respectively, and sub-top-surface knuckles 105. Planchets 106 are provided to indicate the zones of the fabric which would not substantially compress the juxtaposed portions of a sheet of paper being imprinted with the knuckle pattern of fabric 100. Each uncompressed zone spans two warp filaments and two shute filaments; each spans a two-by-two sub-array of knuckles 105. However, whereas the knuckle pattern of fabric 60, FIG. 7, substantially completely perimetrically enclosed discrete cavities indicated by planchets 61*a* through 61*d* in FIG. 7, the zones of fabric 100 indicated by planchets 106, FIG. 13, are in diagonally abutting relation. Therefore, paper imprinted with fabric 100 will tend to have diagonally extending uncompressed ridges which are alternately spaced with diagonally extending lines of compression which are imprinted by alternately spaced coplanar knuckles 103 and 104. Alternatively, fabric 100 can be viewed as comprising diagonally extending troughs comprising diagonally abutting cavities in which troughs zones of paper being imprinted by fabric 100 will not be substantially compressed or compacted.

Figure 14:
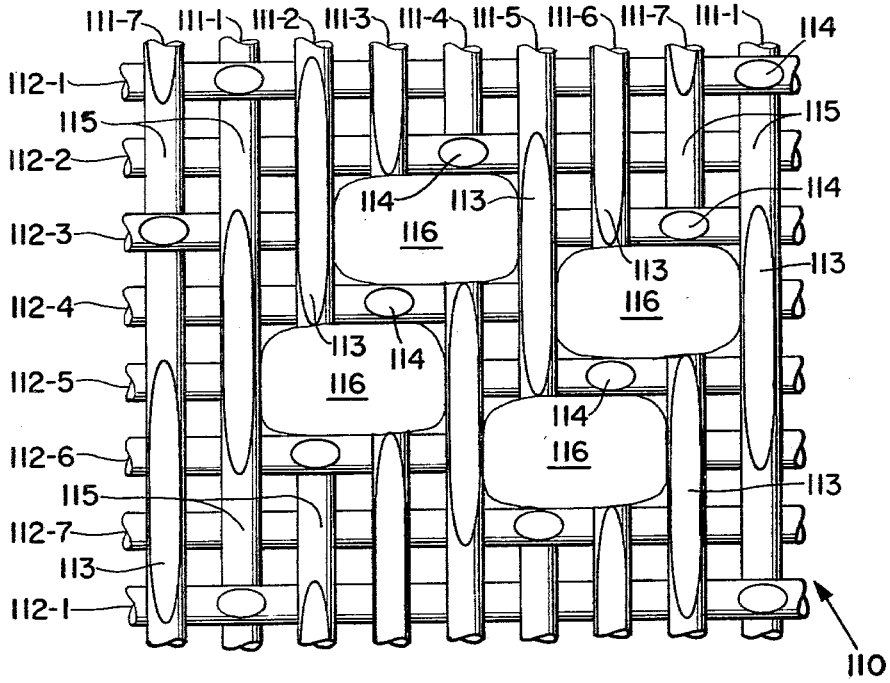

FIG. 14 is a plan view of a fragmentary piece of another alternate embodiment imprinting fabric 110 for making paper embodying the present invention. Fabric 110 is a seven-shed satin weave which comprises warps 111-1 through 111-7 and shutes 112-1 through 112-7, and which fabric has been woven with a 1, 4, 7, 3, 6, 2, 5 warp-pick-sequence. The warps and shutes have coplanar top-surface-plane knuckles 113 and 114, respectively, and sub-top-surface knuckles 115. Planchets 116 indicate zones of non-compression which each span two warp filaments and one shute filament; the same spans as fabric 60, FIG. 7.

Figure 15:
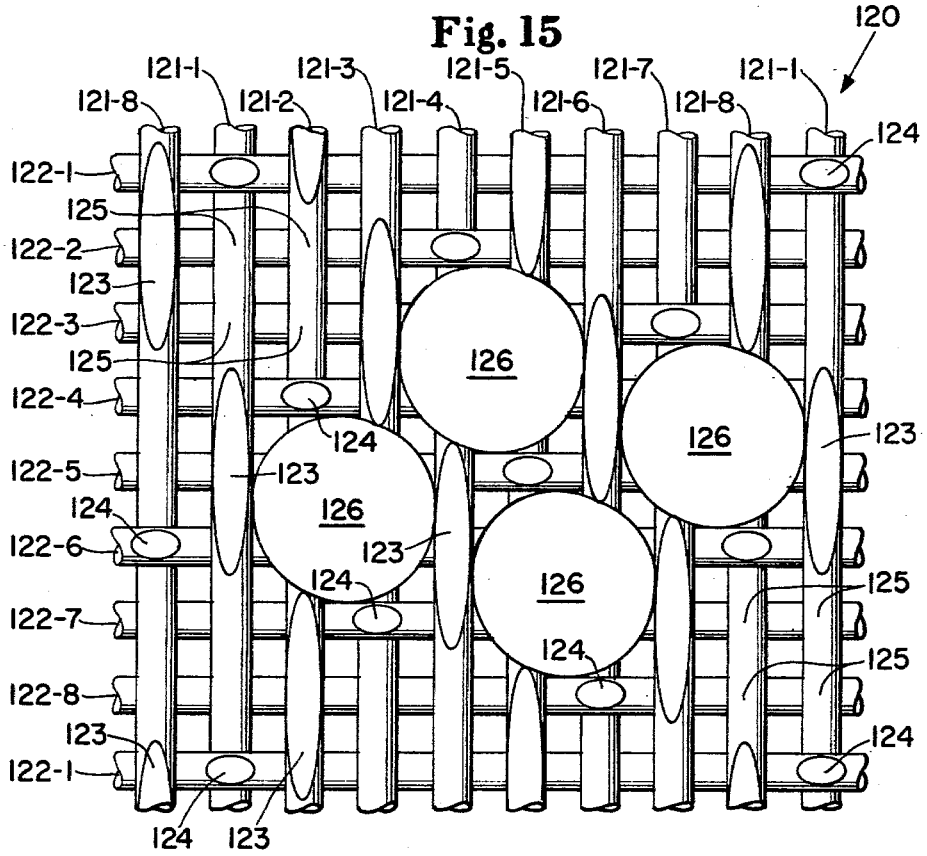

FIG. 15 is a plan view of a fragmentary piece of yet another alternate embodiment imprinting fabric 120 for making paper embodying the present invention. Fabric 120 is an eight-shed satin weave which comprises warps 121-1 through 121-8 and shutes 122-1 through 122-8, and which fabric has been woven with a 1, 4, 7, 2, 5, 8, 3, 6 warp-pick-sequence. The warps and shutes have coplanar top-surface-plane knuckles 123 and 124, respectively, and two-by-two sub-arrays of sub-top-surface knuckles 125. Planchets 126 indicate substantially isotropic zones of non-compression which are said to be isotropic because each zone spans equal numbers of warp and shute filaments; i.e., two each.

Figure 16:
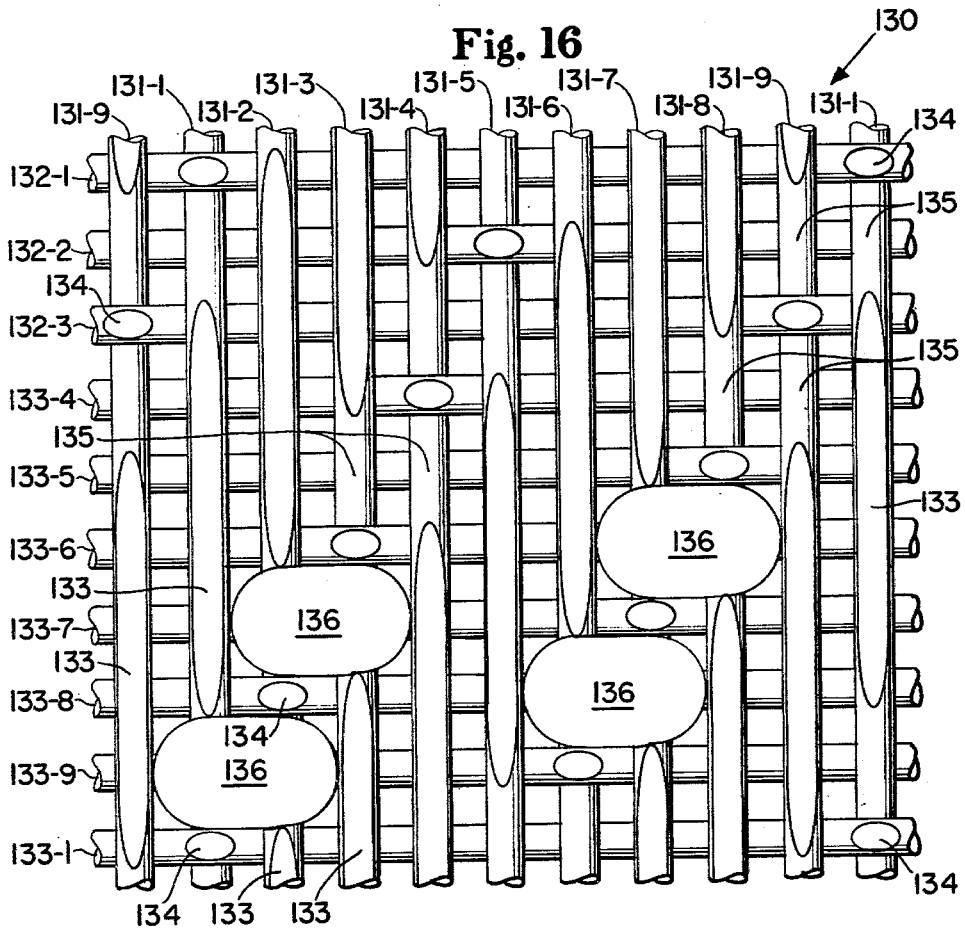

FIG. 16 is a plan view of a fragmentary piece of yet another alternate embodiment imprinting fabric 130 for making paper embodying the present invention. Fabric 130 is a nine-shed satin weave which comprises warps 131-1 through 131-9 and shutes 132-1 through 132-9, and which fabric has been woven with a 1, 5, 9, 4, 8, 3, 7, 2, 6 warp-pick-sequence. The warps and shutes have coplanar top-surface-plane knuckles 133 and 134, respectively, and two-by-two sub-arrays of sub-top-surface knuckles 135. Planchets 136 indicate zones of non-compression which each spans two warp filaments and one shute filament.

Figure 17:
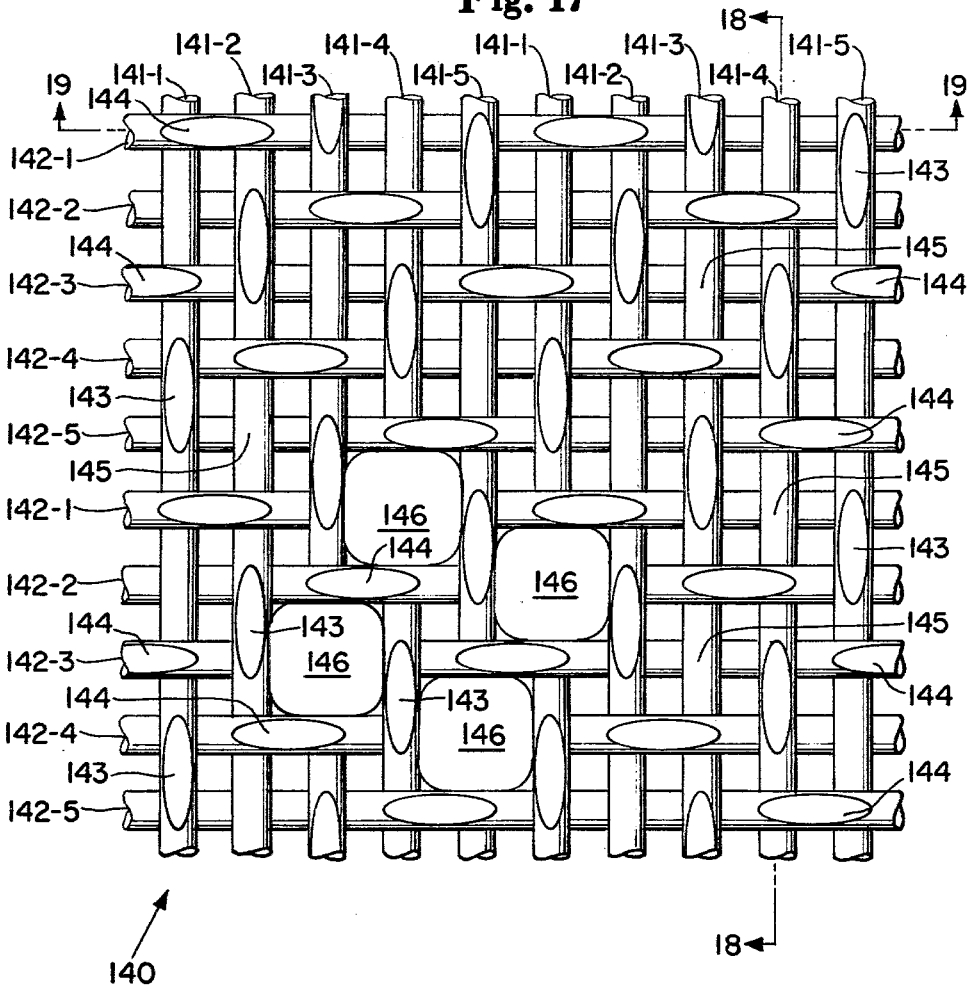
FIGS. 17, and 20 through 22 are enlarged scale fragmentary views of alternate embodiment hybrid weave imprinting fabrics for use in manufacturing paper embodying the present invention.

FIG. 17 is a plan view of a fragmentary piece of yet another alternate embodiment imprinting fabric 140 for making paper embodying the present invention. Fabric 140 is a five-shed hybrid weave which comprises sets of warps 141-1 through 141-5 and sets of shutes 142-1 through 142-5, and which fabric has been woven by passing each shute over two and under three warps and in which each successive shute is passed over the next two successive warps adjacent the pair of warps over which the preceding shute passed. Thus, the shute knuckles of adjacent shutes are offset from each other by the number of filaments spanned by each shute knuckle. The warps and shutes have coplanar top-surface-plane knuckles 143 and 144, respectively, and sub-top-surface knuckles 145. Planchets 146 indicate substantially isotropic zones of non-compression which each span one warp filament and one shute filament; one sub-top-surface knuckle 145.

Figure 18:
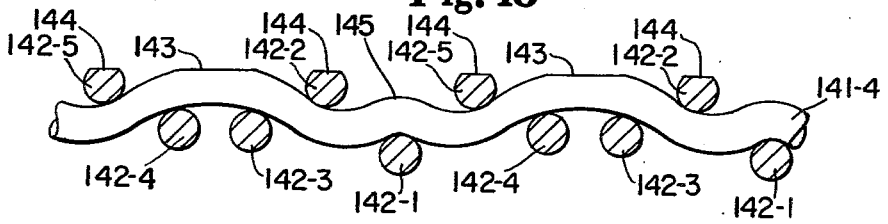
FIGS. 18 and 19 are sectional views taken along line 18—18 and 19—19, respectively, of FIG. 17.
Figure 19:
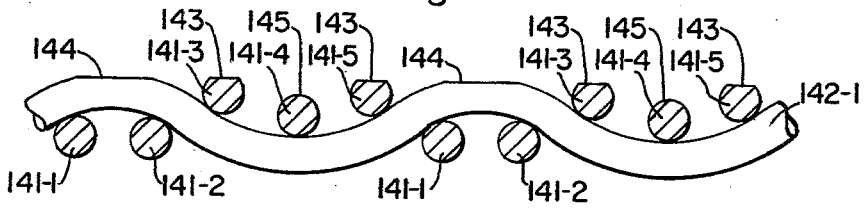

FIGS. 18 and 19 are sectional views taken along lines 18—18 and 19—19, respectively, of FIG. 17. These figures clearly show the heat set complimental serpentine geometry of the warp and shute filaments and the relative elevational dispositions of the knuckles 143, 144 and 145. The zone of non-compression which is superjacent each sub-top-surface knuckle 145 is best seen in FIG. 19.

Figure 20:
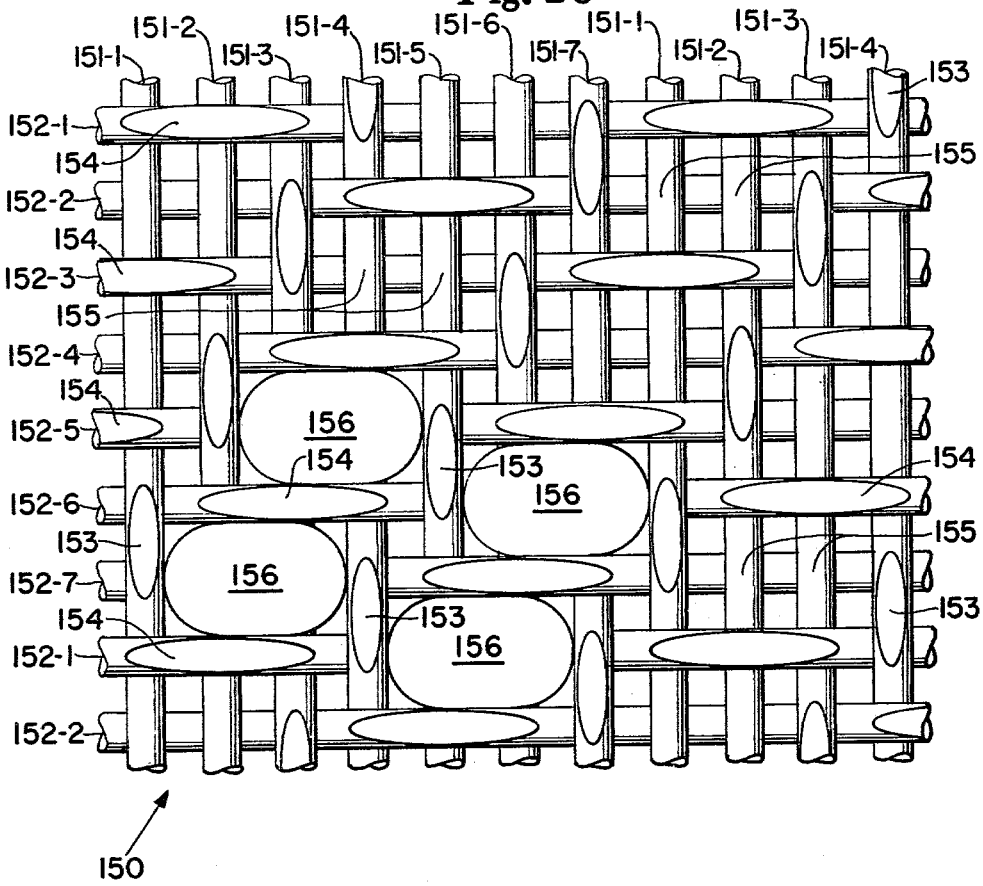

FIG. 20 is a plan view of a fragmentary piece of still yet another alternate embodiment imprinting fabric 150 for making paper embodying the present invention. Fabric 150 is a seven-shed hybrid weave which comprises sets of warps 151-1 through 151-7 and shutes 152-1 through 152-7, and which fabric has been woven with each shute alternately passing over three and under four warps. Also, each successive shute passes over the next subset of three warps adjacent to the subset of three warps over which the preceding shute passed. Thus, the knuckle of adjacent shutes are offset by the number of filaments spanned by each knuckle. In a similar manner, each warp knuckle is offset from the knuckle on adjacent warps by the number of shute filaments spanned by each warp filament knuckle. The warps and shutes have coplanar top-surface-plane knuckles 153 and 154, respectively, and side-by-side pairs of sub-top-surface knuckles 155. Planchets 156 indicate zones of non-compression which each spans two warp filaments and one shute filament.

Figure 21:
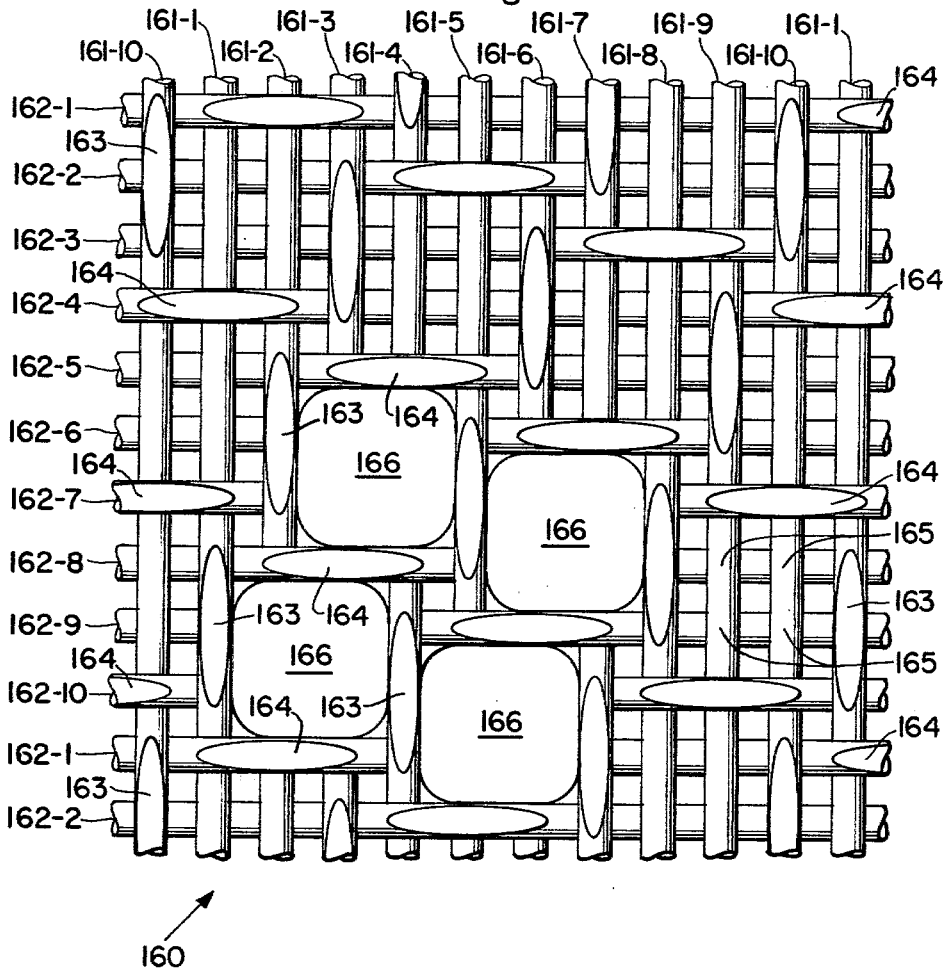
Figure 22:
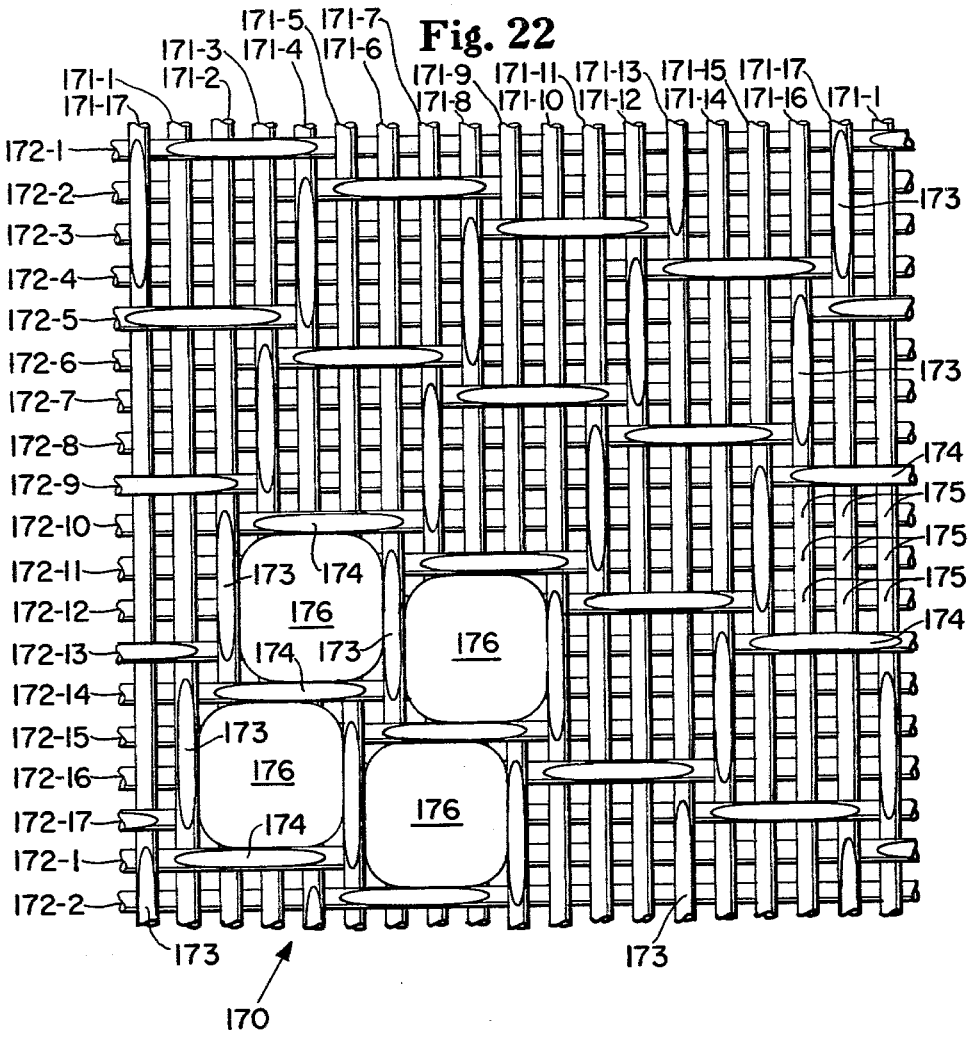

FIGS. 21 and 22 show plan views of fragmentary pieces of still other alternate embodiment imprinting fabrics 160 and 170 which provide isotropic zones of non-compression which span two-by-two arrays of sub-top-surface knuckles and three-by-three arrays of sub-top-surface knuckles 165 and 175, respectively. More specifically, fabric 160, FIG. 21, is a ten-shed hybrid weave which comprises sets of warps 161-1 through 161-10 and sets of shutes 162-1 through 162-10, and are woven to provide equal length, coplanar warp and shute knuckles 163 and 164, respectively. Fabric 160 is so woven that the shute knuckles 164 of adjacent shutes 162 are offset by the number of filaments spanned by each knuckle, and each pair of adjacent warp knuckles are offset by the number of shutes spanned by each warp knuckle. In the same general manner, fabric 170 comprises sets of warp filaments 171-1 through 171-17 and sets of shute filaments 172-1 through 172-17. The fabric is woven in a four over, thirteen under mode to provide coplanar warp knuckles 173 and shute knuckles 174 of equal lengths; each spanning four filaments of the other set.

Additional alternate imprinting fabrics embodying the present invention could, of course, be provided by reversing the designations of warps and shutes in the alternate embodiments described hereinbefore, and/or by taking complimentary warp-pick-sequences as also described hereinbefore: e.g., the compliment of warp-pick-sequence 1, 3, 5, 2, 4 is 1, 4, 2, 5, 3. These additional alternate embodiments are neither shown nor described because of the undue multiplicity and proloxity they would entail. Moreover, while all of the fabric embodiments shown and described have coplanar flat areas on both warp and shute crossovers, it is not intended to thereby limit the present invention to imprinting only with imprinting fabrics such as described and shown herein.

While particular embodiments of the present invention have been illustrated and described, it would be obvious to those skilled in the art to various other changes and modifications can be made without departing from the spirit and scope of the invention. Therefore, it is intended to cover in the appended claims all such changes and modifications that are within the scope of this invention.

What is claimed is:

1. A soft absorbent imprinted paper sheet characterized by a patterned array of relatively closely spaced uncompressed pillow-like zones which zones are each circumscribed by a picket-like lineament comprising alternately spaced areas of compacted fibers and relatively non-compacted fibers, said zones being disposed in staggered relation in both the machine direction and the cross-machine direction of said paper sheet.

2. The paper sheet of claim 1 which is also creped.

3. The paper sheet of claim 1 or 2 wherein adjacent said pillow-like zones are sufficiently closely spaced that the machine direction span of each zone spans the machine direction length of the space intermediate a longitudinally spaced pair of said zones which pair is disposed laterally adjacent said each zone, and said pillow-like zones are sufficiently closely spaced that the cross-machine-direction span of said each zone spans the cross-machine-direction width of the space intermediate a laterally spaced pair of said zones which pair is disposed longitudinally adjacent said each zone.

4. The paper sheet of claim 1 or 2 wherein said zones number from about 15 to about 3,000 per square inch.

5. The paper sheet of claim 1 or 2 wherein said lineaments have been impressed on said sheet by an imprinting fabric prior to the final drying of said sheet while said sheet was being made on a papermaking machine.

6. A method of manufacturing a soft absorbent sheet of paper characterized by a bilaterally staggered array of relatively closely spaced uncompressed pillow-like zones which zones are each circumscribed by a picket-like-lineament of alternately spaced areas of compacted fibers and relatively non-compacted fibers, said method comprising the steps of a. forming an embryonic paper web having substantially uniform density throughout; and
b. imprinting, prior to final drying, a network of picket-like-lineaments on said embryonic web, said lineaments comprising alternately spaced areas of compacted fibers and relatively non-compacted fibers, and said network being so configured that the lineaments discretely perimetrically enclose each zone of a bilaterally staggered array of said uncompressed pillow-like zones in said embryonic paper.

7. The method of claim 6 wherein said sheet of paper is creped and has a relatively high CD:MD stretch ratio, said method further comprising the steps of a. adhering said imprinted embryonic web to a creping surface;
b. fully drying said web; and
c. creping said web from said creping surface when fully dried whereby said web becomes said sheet of paper.

8. The method of claim 6 or 7 wherein said network is so configured that said zones of said array of pillow-like zones are sufficiently overlapped that said array is a fully overlapped bilaterally staggered array.

* * * * *